United States Patent [19]

Gordon

[11] Patent Number: 4,754,566

[45] Date of Patent: Jul. 5, 1988

[54] CLAMPING DEVICE FOR HOLDING FLEXIBLE SHEET MATERIAL AND THE LIKE

[75] Inventor: Thomas Gordon, Hebron, Conn.

[73] Assignee: Metromedia Company, Secaucus, N.J.

[21] Appl. No.: 38,300

[22] Filed: Apr. 14, 1987

[51] Int. Cl.[4] ..... G09F 17/00

[52] U.S. Cl. ..... 40/603; 40/617; 40/624; 40/156

[58] Field of Search ..... 40/156, 603, 617, 152; 160/378; 112/78

[56] References Cited

U.S. PATENT DOCUMENTS

| | | | |
|---|---|---|---|
| 951,921 | 3/1910 | Spencer | 40/156 |
| 1,886,899 | 11/1932 | Overholtz | 40/624 |
| 2,484,349 | 10/1949 | Kelly | 40/156 |
| 2,633,653 | 4/1953 | Angus et al. | 40/156 |
| 2,985,977 | 5/1961 | Roseman | 40/156 |
| 3,095,661 | 7/1963 | Ellis | 40/156 |
| 3,885,335 | 5/1975 | Egermayer | 40/603 |
| 4,194,312 | 3/1980 | Connors et al. | 40/156 |
| 4,516,342 | 5/1985 | Reim | 40/156 |

*Primary Examiner*—Gene Mancene
*Assistant Examiner*—Wenceslao J. Contreras
*Attorney, Agent, or Firm*—McCormick, Paulding & Huber

[57] ABSTRACT

A clamping device for holding flexible sheet material and the like includes a longitudinally elongated receiving member having a receiving channel across which the sheet material passes. A wedging member breaks the plane of the surface of the sheet material and forces the material into the receiving channel. The receiving member includes a base that intersects with the lower edge of a lip member and the lower edge of a rear wall member that is parallel to and spaced apart from the lip member. The intersection of the respective inner surfaces of the base, rear wall and lip member define the receiving channel wherein the lip member inner surface is inclined toward the inner surface of the rear wall. Pulling action on the sheet material in a direction away from the base and along the lip member inner surface tends to urge the wedging member edge into clamping engagement with the sheet material passing between the wedging member edge and adjacent the lip member inner surface whereby the device is held in a self-clamping condition. The clamping device is releasable by providing a force on the sheet material in a direction away from the base and along the inner surface of the rear wall which tends to urge the edge of the wedging member in a direction away from the lip member inner surface and releases the sheet material clamped therebetween. The clamping device is disclosed in another embodiment in combination with a billboard structure wherein a flexible bulletin face sheet material is mounted on and clamped to the billboard structure.

10 Claims, 4 Drawing Sheets

CLAMPING DEVICE FOR HOLDING FLEXIBLE SHEET MATERIAL AND THE LIKE

BACKGROUND OF THE INVENTION

The present invention relates generally to clamping devices for holding flexible sheet material and the like and deals more specifically with a releasable clamping device for holding flexible bulletin face sheet material of the type upon which a large scale graphic is printed and generally supported by a billboard structure and the like.

There has been a substantial increase recently in the use of flexible sheet material as a bulletin face for recording large scale graphics of the type that are displayed on roadside billboards and in large open areas such as for example, transporation terminals, shopping centers and the like. Flexible bulletin face sheet material is generally light weight compared to one system of displaying large scale graphics wherein a number of plywood sections are used with each face displaying a portion of the complete graphic. The sections are usually hoisted into place by a crane and bolted or secured to a framework or structure of some type similar to a roadside billboard and the collective faces of the assembled sections display the complete graphic. The plywood sections and associated graphic portion printed on each of the faces are expensive to produce, difficult to erect and the process is highly labor intensive. In contrast to the plywood section display system, a system using flexible bulletin face sheet material often can be positioned and mounted on a billboard structure without the need of heavy hoisting equipment and the ability to do so is one major reason the flexible sheet display system is preferable to the plywood system.

One flexible bulletin face mounting system uses a flexible bulletin face sheet material that is fabricated with a hem or cuff at the sides or edges around its perimeter. An elongated metal bar is inserted into the cuff by an installer positioned at or near the top of the billboard structure. The hem is scalloped at regularly spaced intervals to expose and provide access to an elongated metal bar that is inserted into the cuff and to which a holding device of some type such as a hook is attached. The hook in turn is generally coupled to a tightening device located on the backside of the billboard structure. The tightening device is operated to pull on the bar and accordingly the bulletin face material. The tension produced across the bulletin face by the tightening device reduces or removes wrinkles in the bulletin face and holds the bulletin face in position against the billboard structure.

One problem usually associated with the mounting and holding of the above-described flexible bulletin face is that the installer must carry and insert a relatively long bar, approximately 14 feet in length through the cuff along the edge of the material. The handling and placement of the bar is sometimes difficult and cumbersome and exposes the installer to the possibility of losing his balance, falling to the ground or some other part of the billboard structure and possibly suffering a serious injury.

Another problem associated with the aforementioned flexible bulletin face and its method of mounting to a billboard is that the scallops in the flexible bulletin face often appear at fixed spaced intervals along the cuff and sometimes are not in alignment with the placement of the holding device on the billboard structure. Consequently, alignment and registry of the graphic printed on the bulletin face with another portion of the graphic contained on a billboard extension may be difficult and in some cases alignment may not be possible and the display may not be pleasing to a viewer.

Yet another problem associated with the aforementioned flexible bulletin face is a higher labor cost incurred during manufacturing due to the inclusion of a cuff along the material's edge for receiving the metal folding bar.

A further problem associated with the above-mentioned cuff type bulletin face and associated holding device is that it is difficult and often inconvenient to reposition the bulletin face on the billboard surface.

Yet a further problem associated with the cuff type bulletin face and associated mounting system is that the face, when rolled for carrying or storage has a "bar bell" appearance and consequently, a number of such rolled bulletin faces cannot be easily stacked or stored.

It would be desirable therefore to provide a clamping device for holding flexible sheet material and the like, specifically the type used for providing a bulletin face upon which large scale graphics are printed, that overcomes the above-mentioned problems.

It is an object therefore of the present invention to provide a clamping device for holding flexible sheet material that overcomes the above described problems.

It is another object of the present invention to provide a clamping device of the type for use with a billboard structure to hold a cuffless, flexible bulletin face sheet material upon which a desired graphic is printed and displayed.

It is yet a further object of the present invention to provide a clamping device that is positionable and operable at any desired position across the face of a flexible sheet material.

It is yet another object of the present invention to provide a clamping device that is easily operable between a clamping condition and a non-clamping condition to facilitate the positioning of a flexible bulletin face on a billboard structure and for clamping the bulletin face to the structure.

SUMMARY OF THE INVENTION

In accordance with the present invention, a clamping device for holding flexible sheet material and the like is presented. The clamping device of the present invention is particularly suited for mounting and holding flexible bulletin face sheet material to and on a billboard structure. The device includes a longitudinally elongated receiving member having a rear wall with upper and lower edges being parallel to one another and having an inner wall surface. A longitudinally elongated lip member has an inner lip surface and includes an upper ridge and a lower edge substantially parallel to the upper ridge and the lip member is parallel with and in a spaced relationship to the rear wall and the inner lip surface is inclined toward the rear wall. The receiving member also includes a base having an inner surface and intersects with the lower edge of the rear wall and the lower edge of the lip member and the inner surfaces of the rear wall, base, and lip member define a receiving channel. A longitudinally elongated wedging member includes a first longitudinal edge and a second longitudinal edge in a spaced relationship to one another and at a predetermined distance from one another. The first edge lies in a first plane and the second edge lies in a second plane and the first and second planes intersect each other at substantially right angles and each of the first and second planes define a first and second surface. The wedging member is arranged for complementary engagement with the receiving member and breaks the plane of the surface of a flexible sheet material extending between the upper edge of the receiving member rear wall and the upper ridge of the lip member when the wedging member is inserted into the receiving channel. The sheet material passing between the lip member inner surface and the first edge of the wedging member and between the inner wall surface and the second edge of the wedging member is retained in a clamped condition when the wedging member is rotated to urge the first edge in the direction of the lip member inner surface whereby the sheet material is squeezed between the lip member inner surface and the first edge of the wedging member along a first longitudinal contact line.

A feature of the clamping device is that any pulling action on the sheet material in a direction along the inner lip surface and away from the base produces a force that tends to urge the wedging member first edge into the lip member inner surface whereby the first edge is moved into clamping engagement with the sheet material adjacent the inner lip surface and the clamping device is held in a clamping condition.

In another embodiment of the invention, security means is provided along the upper edge of the rear wall of the receiving member and includes a hinge assembly having one hinge portion fixedly connected to the rear wall and a second hinge portion arranged for pivotal movement about the hinge axis and toward the inner surface of the rear wall and into contact with the wedging member inserted in the receiving channel to prevent the deliberate or accidental release of the wedging member. The movable hinge portion is rotated in a direction away from the inner surface of the rear wall a sufficient distance to permit the removal of the wedging member and the release of the sheet material held by the clamping device.

BRIEF DESCRIPTION OF THE DRAWINGS

Other objects, features and advantages of the clamping device embodying the present invention will be readily apparent from the following written description and claims taken in conjunction with the drawings wherein:

DETAILED DESCRIPTION OF THE PREFERRED EMBODIMENTS

Figure 1:
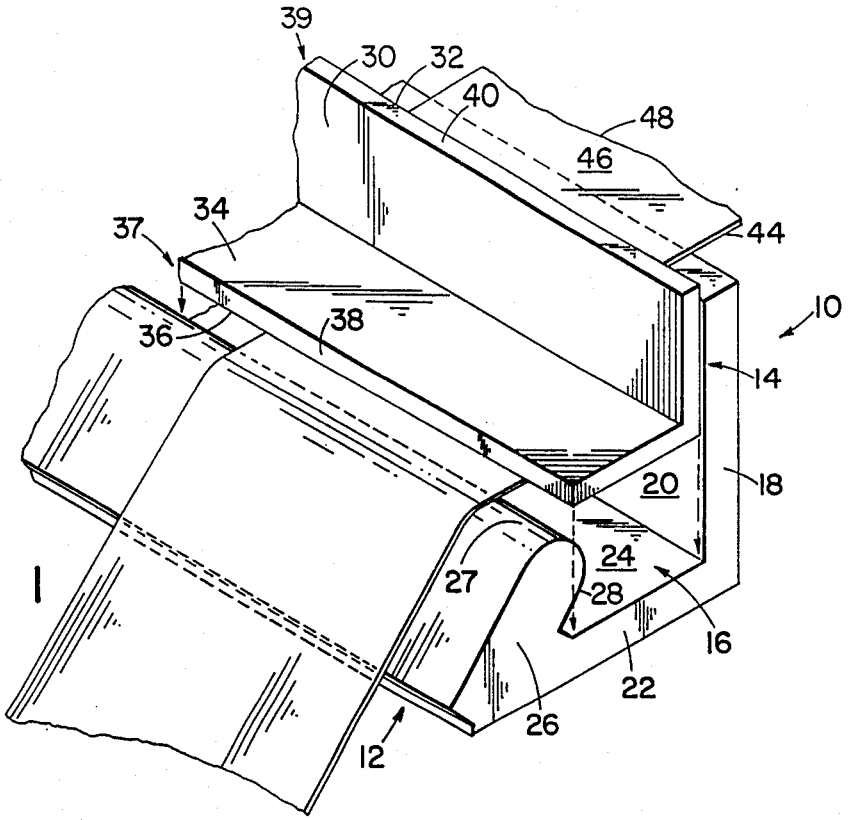
FIG. 1 is a perspective, exploded view of a clamping device embodying the present invention for holding flexible sheet material and the like wherein a flexible sheet is shown positioned between a receiving member and a wedging member wherein the wedging member is shown partially breaking the plane of the surface of the sheet material passing over the ridge of the lip member and the edge of the rear wall of the receiving member.
Figure 2:
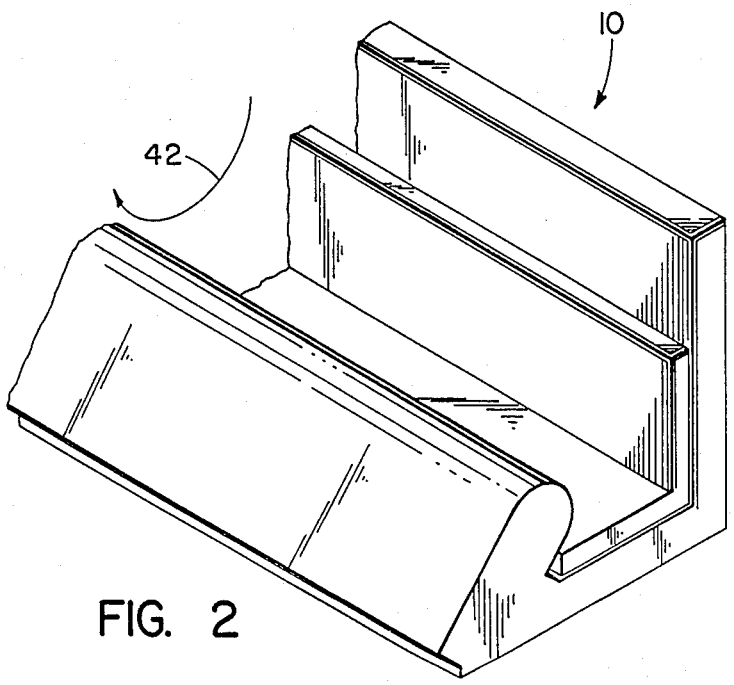
FIG. 2 is a perspective view of the clamping device of FIG. 1 without the sheet material wherein the wedging member is shown inserted in the receiving channel of the receiving member.

Turning now to the drawings and considering FIGS. 1 and 2 specifically, the clamping device embodying the present invention is shown therein and designated 10. The clamping device 10 includes a longitudinally elongated receiving member 12 and a longitudinally elongated wedging member 14. The wedging member 14 is arranged for complementary engagement with the inner surfaces of a receiving channel 16 of the receiving member 12.

The receiving member 12 includes a longitudinally elongated and rectangularly shaped rear wall 18 having an inner planar surface 20 and a longitudinally elongated, rectangularly shaped base 22 having an inner planar surface 24 intersecting at substantially right angles to the surface 20 of the wall 18. The receiving member 12 further includes a longitudinally elongated rectangularly shaped lip member 26 in a spaced-apart relationship with the wall 18. The lip member 26 intersects the base 22 along a line substantially parallel to the wall 18 in the longitudinal direction. The lip member 26 has an inner surface 28 which surface is inclined with respect to the surface 24 of the base 22 and in a direction toward the surface 20 of the wall 18. The lip member inner surface 28 together with the surfaces 20 of the rear wall 18 and the surface 24 of the base 22 define the receiving channel 16 of the receiving member 12. The lip member 26 has a longitudinal ridge 27 at its edge opposite the base 22 and the ridge is slightly rounded to facilitate movement of a sheet material surface over the ridge. The rounded ridge 27 also provides a smooth contact surface over which the sheet material may be pulled into the receiving channel 16 and which surface prevents "knife edge" cutting of the material.

The wedging member 14 includes a longitudinally elongated, rectangularly shaped wall 30 having a rear surface 32 and a contact surface 40 along one edge 39 of the wall 30. A second longitudinally elongated rectangularly shaped wall 34 having a bottom surface 36 and a contact surface 38 along one edge 37 of the wall 34 intersects the first wall 30 at a substantially right angle. The contact surface 38 along edge 37 of the wall 34 is substantially parallel to and in a spaced-apart relationship with the surface 32 of the wall 30 in the longitudinal direction. The contact surface 40 along the edge 39 of the wall 30 is substantially parallel to and in a spaced-apart relationship with the surface 36 of the wall 34.

When the wedging member 14 is positioned in the receiving channel 16 of the receiving member 12 as shown in FIG. 2 and the wedging member is rotated in the direction of arrow 42, the surface 38 along edge 37 of the wedging member 14 comes into contact with the inner surface 28 of the lip member 26 along a narrow longitudinal surface area. Likewise, when the wedging member 14 is rotated in the direction of arrow 42, the surface 40 along the edge 39 comes into contact with the inner surface 20 of the wall 18 along a narrow longitudinal surface area extending the length of the edge 39.

Still referring to FIGS. 1 and 2, it will be readily appreciated that a flexible sheet material 44 having an upper surface 46 and a lower surface 48 will be forced into the receiving channel 16 by the insertion of the wedging member 14 into the channel. The sheet material 44 is held by way of the gripping action produced through the squeezing of the material 44 between the surface 28 of the lip member 26 and the surface 38 of the edge 37. The sheet material 44 is also held by way of the gripping action produced through the squeezing of the material passing between the surface 40 of the edge 39 of the wedging member 14 and the rear wall surface 20 comprising the receiving channel 16.

Figure 3:
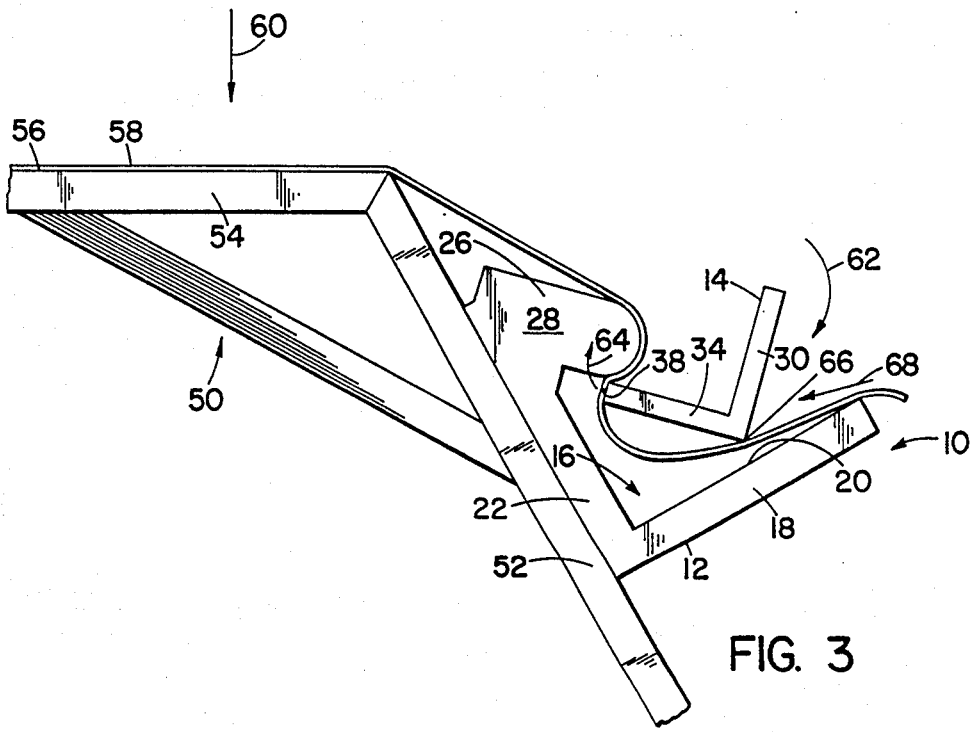
FIG. 3 is an end view of the clamping device of FIG. 1 wherein the receiving member is shown mounted to one side of a partially shown billboard structure wherein a flexible bulletin face sheet material is shown passing in the receiving channel of the receiving member and the wedging member is shown partially inserted into the channel forcing the bulletin face material between the inner lip surface of the receiving member and one clamping edge of the wedging member.
Figure 4:
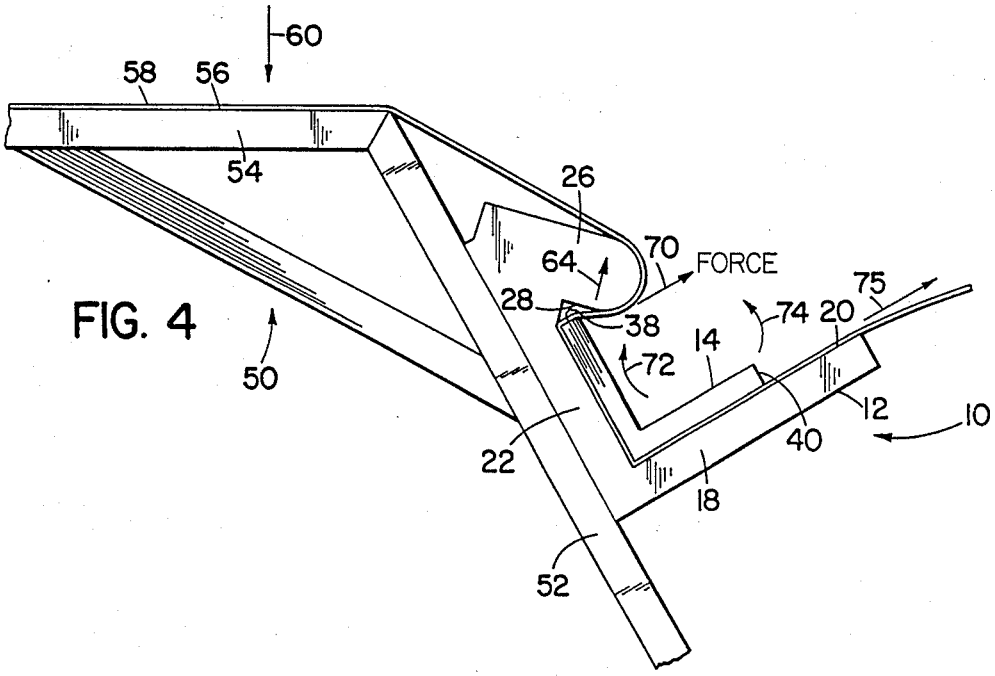
FIG. 4 shows the clamping device of FIG. 3 wherein the wedging member is shown in its clamping position in the receiving channel of the receiving member and in engagement with the flexible sheet material passing between the wedging and receiving members.

Considering now FIGS. 3 and 4, the clamping device 10 embodying the present invention is shown by way of example in an end view with its base 22 attached to a billboard structure 50 wherein the billboard is shown in a fragmented end view. The billboard structure 50 includes a side supporting member 52, a bulletin face supporting member 54 having a supporting face 56 across which a bulletin face 58 is supported for viewing from a direction indicated by the arrow 60. The base 22 of the longitudinal receiving member 12 is connected or otherwise fastened to the side member 52 of the billboard structure 50 in any well known manner. Although the clamping device is shown for illustrative purposes connected to a side support member of the billboard structure 50, it will be understood that the clamping device may be located at any position at which it is desired to clamp and hold the sheet material.

As illustrated in FIGS. 3 and 4, the flexible bulletin face material 58 is inserted across the face 56 of the billboard structure 50 and over the rounded ridge 27 of the lip member 26 into the receiving channel 16. The wedging member 14 is inserted into the channel 16 and rotated along its length in the direction of arrow 62 whereby the surface 38 of edge 37 comes into contact with the surface of the bulletin face 58. The bulletin face 58 is urged in the direction of arrow 64 and into contact with the inner surface 28 of the lip member 26. The wedging member 14 is further rotated in the direction of arrow 62 into the channel 16 causing an outer corner 66 of the wedging member, substantially defined by the intersection of the outer surfaces 32 and 36 of walls 30 and 34 respectively, to come into contact with the bulletin face material 58. The pushing action of the corner 66 against the bulletin face tends to draw the slack material along the surface 20 of the wall 18 in a direction toward the base surface 24 indicated by arrow 68. Once the wedging member 14 is inserted into the receiving channel 16 and rotated to its clamping position, any force applied to the bulletin face 58 in the direction of arrow 70 tends to rotate the wedging member 14 further in the direction of arrow 72. The tendency of the wedging member to rotate further increases the squeezing action on the bulletin face 58 passing between the inner surface 28 of the lip member 26 and the surface 38 along the edge 37 of the wedging member 14. In addition, the surface 40 along edge 39 also tends to rotate further into contact with the surface 20 and provides additional squeezing of the bulletin face 58 at an additional point in the receiving channel. It will be appreciated that the clamping device 10 embodying the present invention tends to be self-clamping due to the action of the sheet material urging the wedging member 14 into clamping engagement with the surfaces of the receiving channel 16 as explained above.

In cases where it is desired to reposition or release the clamped bulletin face 58, the clamping device 10 is easily operated to its non-clamping condition by rotation of the wedging member 14 in the direction of arrow 74. One method for easily releasing the clamping device 10 to bring the surface 38 along edge 37 of the wedging member 14 out of gripping engagement with the bulletin face 58 and the inner surface 28 of the lip member 26 is to apply a force to the bulletin face in a direction along the surface 20 and in the direction of arrow 75. The force on the bulletin face material tends to rotate the wedging member 14 in the direction of arrow 74 and to its non-clamping condition to release the bulletin face 58. After the bulletin face 58 is positioned as desired, it is reclamped and held as described above.

Figure 5:
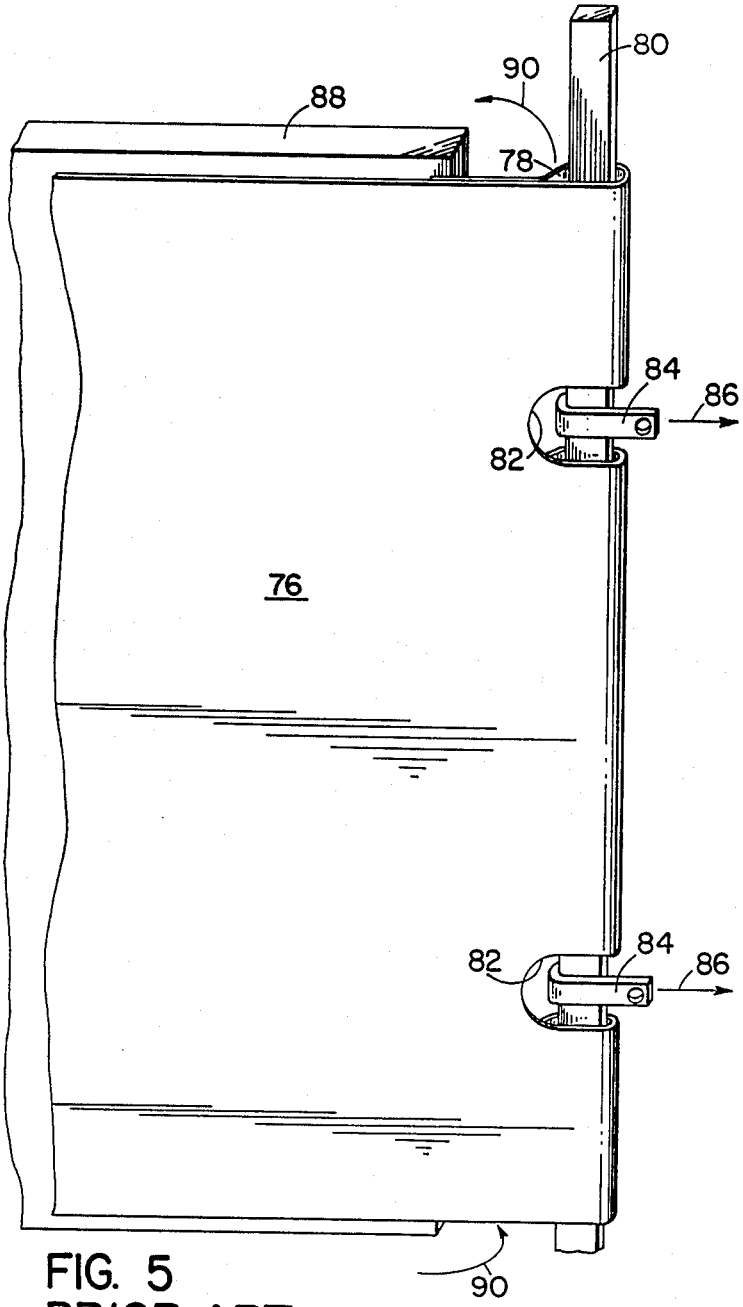
FIG. 5 PRIOR ART
FIG. 5 is a somewhat diagramatic view of a cuffed flexible bulletin face showing the metal holding bar inserted into the cuff and to which bar tensioning and holding hooks are attached for mounting the bulletin face to and across the face of a billboard structure.

It is readily seen that the clamping device 10 can be located at convenient locations on the billboard structure to hold the bulletin face 58 and its mounting location is not restricted to a given location as is required by one system of the prior art illustrated in FIG. 5. As shown in FIG. 5, a flexible bulletin face 76 includes a cuff 78 through which an elongated metal bar 80 is inserted longitudinally. The cuff 78 includes scallops 82,82 to expose the inserted bar 80 for attachment by devices such as hooks 84,84 which are coupled to tightening devices which when operated, pull transversely to the elongated bar in the direction of arrow 86. Generally, the bulletin face 76 is wrapped around to the back portion of the billboard structure 88 in the direction of arrow 90 and the tightening devices located on the back portion of the billboard structure operate to pull on the hooks 84,84 and the bar 80 to tension the bulletin face 76 and hold it in place. Consequently, the position of a bulletin face held by the prior art holding arrangement described above has a positioning range limited to the amount of material that can be pulled to the rear of the billboard. Furthermore, the location of the tightening mechanisms is generally restricted to the regions where access can be had to the bar in the cuff. Accordingly, repositioning and accurate registration of the bulletin face 76 and an extension portion of the billboard is often difficult and in some cases is not possible.

Figure 6:
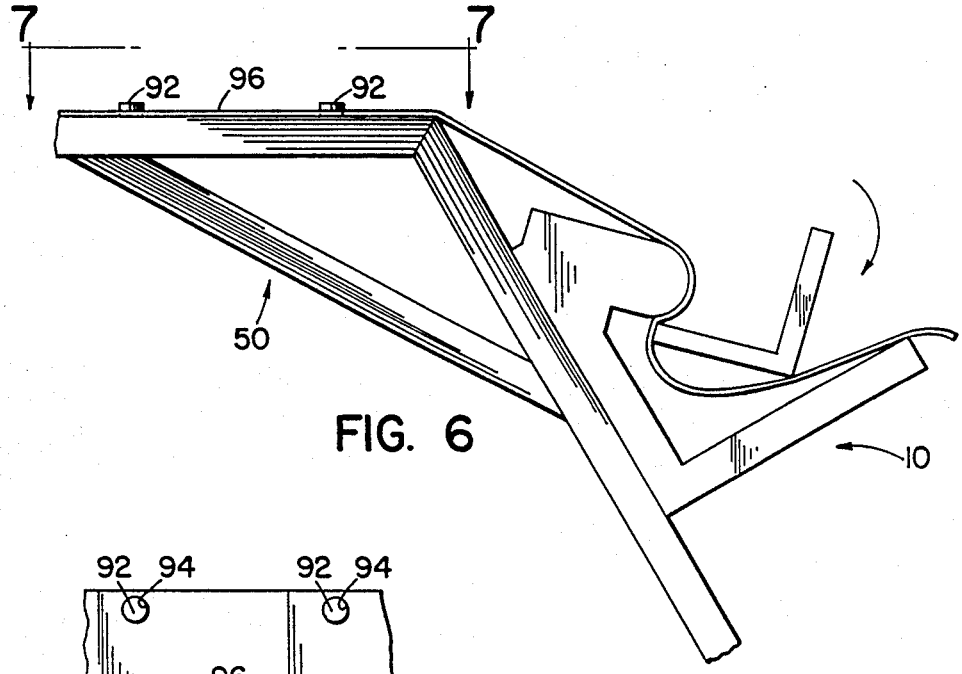
FIG. 6 shows a top view of the clamping device of FIG. 1 mounted on a billboard structure wherein the billboard face includes registration pins for locating the flexible bulletin face prior to clamping into position by the clamping device.
Figure 7:
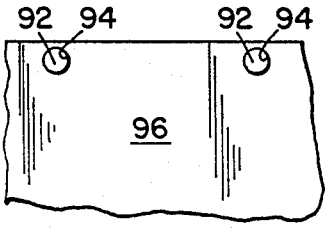
FIG. 7 shows diagramatically a portion of a flexible bulletin face having registration aperatures which are used for positioning the bulletin face on a billboard arranged with registration pins.

In contrast to the prior art bulletin face mounting arrangement illustrated in FIG. 5, the mounting arrangement illustrated in FIG. 6 permits easy and accurate registration of a bulletin face on a billboard and utilizes the clamping device 10 of the present invention described above in connection with the discussion of FIGS. 3 and 4. The billboard structure 50 illustrated in FIG. 6 is similar to the structure of FIGS. 3 and 4 and additionally includes locating pins 92,92 that project outwardly and substantially perpendicularly from the face 56 of the billboard. The pins 92,92 are located at predetermined positions on the billboard face 56 and correspond to the location of openings or aperatures 94,94 through the bulletin face sheet material 96. The positioning of the aperatures 94,94 are at predetermined locations through the bulletin face and are used in conjunction with the pins 92,92 during the mounting of the bulletin face to position the bulletin face in a desired placement. Accurate placement of the bulletin face is especially important and critical when used with billboard extensions that extend beyond the edges of the billboard face and upon which an additional portion of the graphic is located which when taken in combination with the graphic on the bulletin face provides a complete graphic display. Consequently, the registration of the bulletin face is facilitated by locating the bulletin face such that the pins 92,92 are in registry with the corresponding aperatures 94,94. This method of bulletin face registration is facilitated through the use of the clamping device 10 of the present invention because the device 10 can clamp and hold the bulletin face material at any point along the material surface and repositioning and reclamping of the bulletin face is easily accomplished to accomodate and compensate for irregularities in the billboard structure or bulletin face.

Figure 8:
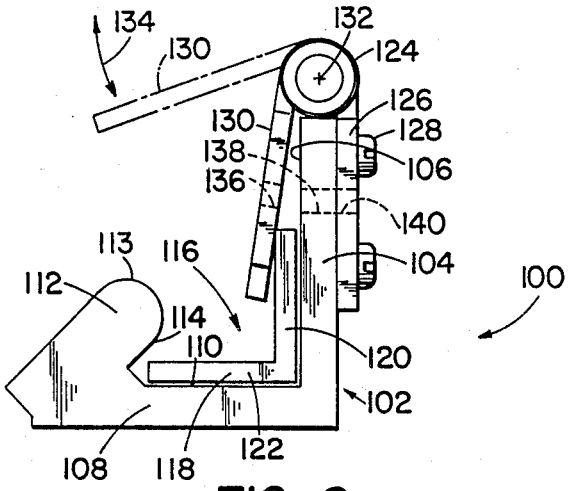
FIG. 8 is another embodiment of the clamping device of the present invention wherein the clamping device includes a lockable safety hold-down mechanism to prevent the release of the wedging member from its clamping position.

Turning now to FIG. 8, another embodiment of the present invention is shown therein and designated 100. The clamping device 100 is similar to the clamping device 10 described above and includes a longitudinally elongated receiving member 102 having a rear wall 104 and an inner surface 106, a base 108 having an inner surface 110 and the surfaces of the base 108 and wall 104 intersect at substantially right angles to one another. A longitudinally elongated lip member 112 is located opposite and at a spaced-apart relationship with the surface 106 of the wall 104. The lip member 112 includes an inner surface 114 and a rounded ridge 113 at its edge opposite the base 108 and the inner surface 114 is inclined toward the surface 106 of the wall 104. The respective surfaces 106,110 and 114 of the wall 104, base 108 and lip member 112 define a receiving channel 116. A wedging member 118 cooperates with the receiving member 102 and includes rectangularly shaped longitudinal members 120,122 intersecting at substantially right angles to one another and the wedging member 118 is similar in appearance and construction to the wedging member 14 above.

The clamping device 100 further includes a hinge assembly 124 having one hinge portion 126 connected to the wall 104 by fastening means such as a screw 128 passing through a hole in the hinge member 126 and threaded into the wall 104. Another hinge portion 130 pivots about a hinge axis 132 of the assembly 124 in the direction of arrow 134 toward the inner surface 106 of the wall 104 to hold an inserted wedging member 118 in place in the receiving channel 116 when the hinge portion 130 is operated to its holding position. The wedging member 118 is releasable from its clamping condition when the hinge portion 130 is moved in a direction away from the inner surface 106 of the wall 104 and is operated to its released position as shown in phantom in FIG. 8. An opening or hole 136 in the hinge portion 130 is in registry with a hole 138 through the wall 104 and a hole 140 through the hinge portion 126 to permit a locking device to be inserted therethrough to prevent the rotation of the hinge portion 130 and prevent the removal of the wedging member 118 from the receiving channel 116 of the clamping device 100. The locking arrangement operates as a safety and security mechanism to prevent the accidental or deliberate release of the bulletin face material to deter to vandalism to or theft of the bulletin face mounted on a billboard structure equipped with the clamping device.

A clamping device for holding flexible sheet material and the like has been described in several preferred embodiments. Numerous changes and modifications may be made by those skilled in the art without departing from the scope and spirit of the invention and therefore, the invention has been described by way of example rather than limitation.

I claim:

1. A clamping device for holding flexible sheet material and the like, said device comprising:

a longitudinally elongated receiving member including:

a rectangularly shaped rear wall having an inner wall surface, an upper edge and a lower edge substantially parallel to said upper edge;

a longitudinally elongated lip member having an inner lip surface, an upper ridge and a lower edge substantially parallel to the upper ridge, said lip member extending substantially parallel with and in a spaced relationship to said rear wall, said inner lip surface being planar and inclined toward said rear wall;

a base, said base having an inner surface, said lower edge of said rear wall and said lower edge of said lip member intersecting said base, and the intersection of said wall inner surface and said base inner surface and said lip member inner surface defining a receiving channel therebetween, and a longitudinally elongated wedging member cooperating with said receiving member and including, a first longitudinal edge lying in a first plane, a second longitudinal edge lying in a second plane, said second edge being parallel with said first longitudinal edge and coupled to said first edge, said first and second edges being in a spaced relationship to one another and at a predetermined distance from one another, said predetermined distance being greater than the distance between a first longitudinal contact line along said lip inner surface and a second longitudinal contact line along said wall inner surface, said first contact line being defined by the intersection of a plane coplanar with said lip inner surface and said first longitudinal edge and said second contact line being defined by the intersection of a plane coplanar with said wall inner surface and said second longitudinal edge;

said wedging member breaking the plane of the surface of a flexible sheet material extending between said upper edge of said receiving member rear wall and said upper ridge of said receiving member lip member when said wedging member is inserted into said receiving channel wherein the sheet material passes between said lip member inner surface and said first edge of said wedging member and between said inner wall surface and said second edge of said wedging member, said sheet material being retained in a clamped condition when said first edge is rotated in the direction of said lip member inner surface whereby said material is squeezed between said lip member inner surface and said first edge of said wedging member in the region along said first contact line.

2. A clamping device as defined in claim 1 wherein said sheet material further passes between said rear wall inner surface and said second edge of said wedging member, said sheet material being retained in said clamped condition when said wedging member is rotated into its clamping position whereby said material is squeezed between said rear wall inner surface and said second edge of said wedging member in the region along said second contact line.

3. A clamping device as defined in claim 2 wherein said wedging member is rotated into its clamping position by the action of said sheet material producing a force on said wedging member first edge tending to urge said wedging member first edge into said lip inner surface when said sheet material passing between said first edge and said lip inner surface is pulled in a direction tending to produce a force in a direction generally away from said base and transverse to said lip inner surface whereby said first edge is moved into clamping engagement with said sheet material adjacent said lip inner surface.

4. A clamping device as defined in claim 2 wherein said wedging member is rotated into a non-clamping position by the action of said sheet material producing a force on said wedging member first edge tending to urge said wedging member first edge away from said lip inner surface when said sheet material passing between said second edge and said rear wall inner surface is pulled in a direction tending to produce a force in a direction generally away from said base and transverse to said rear wall inner surface whereby said second edge is moved in a direction toward said lip member and away from said rear wall inner surface and said first edge is moved out of clamping engagement with said sheet material adjacent said lip inner surface.

5. A clamping device as defined in claim 1 wherein said first edge comprises the first edge of a first longitudinally elongated, rectangularly shaped wall and said second edge comprises the first edge of a second longitudinally elongated, rectangularly shaped wall, said first and second walls intersecting at substantially right angles to one another.

6. A clamping device as defined in claim 1 wherein said device includes security device means for retaining said wedging member in its clamping condition when said security device is operated to its holding position and for permitting the release of said wedging member from its clamping condition when said security device is operated to its released position.

7. A clamping device as defined in claim 6 wherein said security device means comprises a hinge assembly mounted to said receiving member rear wall, said hinge assembly having a first hinge portion fixedly attached to said rear wall and a second hinge portion pivotally coupled to said first hinge portion for rotation about a hinge axis extending longitudinally and parallel with said upper edge of said rear wall, said second hinge portion rotating toward said inner surface of said rear wall to retain said wedging member second edge between said rear wall inner surface and said second hinge portion, and said second hinge portion rotating away from said inner surface of said rear wall a sufficient distance to permit the movement of said wedging member to its released condition.

8. A clamping device for holding flexibe sheet material and the like, said device comprising a longitudinally elongated receiving member, said receiving member including a first surface lying in a first plane, a second surface lying in a second plane, said first and second planes intersecting at substantially right angles to one another, a third surface lying in a third plane, said third plane intersecting said second plane at an acute angle and inclined generally toward said first surface, said first, second and third surfaces defining a receiving channel;

a longitudinally elongated wedging member, said wedging member including a fourth surface lying in a fourth plane and a fifth surface lying in a fith plane, said fourth and fifth planes intersecting at substantially right angles to one another, said wedging member being arranged for complementary placement within said receiving channel whereby said fourth plane is parallel with said first plane and said fifth plane is parallel with said second plane, and said wedging member fourth and fifth surfaces being in contact with one side of sheet material located within the receiving channel, said other side of the sheet material being in contact with said first, second and third surfaces of said receiving channel, and said wedging member rotating about a longitudinally extending axis when said sheet material is pulled with a force and in a direction tending to urge said wedging member fourth surface in a direction toward said receiving member third surface and said wedging member fifth surface toward said receiving member first surface to form a first longitudinal contact line between said third and fourth surfaces and a second longitudinal contact line between said fifth and first surfaces, said first contact line defined by the intersection of said third and fourth planes and said second contact line defined by the intersection of said fifth and first planes whereby said sheet material is held in clamping engagement in the regions along said first and second contact lines.

9. In combination with a billboard structure having a face for displaying a graphic and the like, a clamping device for mounting and holding a flexible bulletin face sheet material adjacent to the billboard face, said device comprising:

a longitudinally elongated receiving member including, a rectangularly shaped rear wall having an inner wall surface, an upper edge and a lower edge substantially parallel to said upper edge;

a longitudinally elongated lip member having an inner lip surface, an upper ridge and a lower edge substantially parallel to the upper ridge, said lip member extending substantially parallel with and in a spaced relationship to said rear wall, said lip inner surface being planar and inclined toward said rear wall;

a base, said base having an inner surface and arranged for attachment to said billboard structure at a desired clamping location, said lower edge of said rear wall and said lower edge of said lip member intersecting with said base and the respective inner surfaces of said wall, base and lip defining a receiving channel therebetween, and a longitudinally elongated wedging member including a first longitudinal edge lying in a first plane, a second longitudinal edge lying in a second plane, said second edge being parallel with said first longitudinal edge and coupled to said first edge, said first and second edges being in a spaced relationship to one another and at a predetermined distance from one another, said predetermined distance being greater than the distance between a first longitudinal contact line along said lip inner surface and a second longitudinal contact line along said rear wall inner surface, said first contact line being defined by the intersection of a plane coplanar with said lip inner surface and said first longitudinal edge and said second contact line being defined by the intersection of a plane coplanar with said rear wall inner surface and said second longitudinal edge;

said wedging member breaking the plane of the surface of the flexible bulletin face sheet material extending between said upper edge of said receiving member rear wall and said upper ridge of said receiving member lip member when said wedging member is inserted into said receiving channel wherein the bulletin face passes between said lip member inner surface and said first edge of said wedging member and between said rear wall inner surface and said second edge of said wedging member, said bulletin face being retained in a clamped condition by the action of said bulletin face sheet material pulling on said wedging member first edge tending to urge said first edge in the direction of and into said lip member inner surface whereby said bulletin face adjacent said lip inner surface is squeezed between said lip member inner surface and said first edge of said wedging member in the region along said first contact line.

10. In combination with a billboard structure, a clamping device as defined in claim 9 wherein said device includes security device means for retaining said wedging member in its clamping condition when said security device is operated to its holding position and for permitting the release of said wedging member from its clamping condition when said security device is operated to its released position.

* * * * *